United States Patent [19]

Mayumi et al.

[11] 4,289,990

[45] Sep. 15, 1981

[54] SPARK PLUG WITH A STEPPED INSULATOR AND AN INNER CONSTRICTION IN THE HOUSING

[75] Inventors: Kazuhisa Mayumi, Aichi; Katsumi Suzuki, Toyota; Fujio Tsuboi, Nagoya, all of Japan

[73] Assignees: Toyota Jidosha Kogyo Kabushiki Kaisha, Toyota; NGK Spark Plugs Co., Ltd., Nagoya, both of Japan

[21] Appl. No.: 20,323

[22] Filed: Mar. 14, 1979

[30] Foreign Application Priority Data

Oct. 17, 1978 [JP] Japan ..... 53-143091[U]

[51] Int. Cl.[3] ..... H01T 13/20; H01T 13/32

[52] U.S. Cl. ..... 313/143

[58] Field of Search ..... 313/130, 143

[56] References Cited

U.S. PATENT DOCUMENTS 967,283 8/1910 Wideen ..... 313/143

2,150,728 3/1939 Nowosielski ..... 313/143 X 3,037,140 5/1962 Schurecht ..... 313/130 X 3,313,972 4/1967 Beesch ..... 313/130

FOREIGN PATENT DOCUMENTS 733482 of 1932 France ..... 313/143

*Primary Examiner*—Robert Segal

*Attorney, Agent, or Firm*—Finnegan, Henderson, Farabow, Garrett & Dunner

[57] ABSTRACT

A spark plug is disclosed, in which the insulator is formed with a stepped portion near its tip portion and the housing which surrounds the insulator is formed with an inner constriction which opposes the smaller portion of the insulator, near the stepped portion, with a small annular gap being left therebetween, thereby hindering the entry of air/fuel mixture and carbon particles into the inner space between the housing and the insulator, and thus reducing the buildup of carbon on the insulator.

1 Claim, 3 Drawing Figures

SPARK PLUG WITH A STEPPED INSULATOR AND AN INNER CONSTRICTION IN THE HOUSING

BACKGROUND OF THE INVENTION

This invention relates to a spark plug, and more particularly relates to a spark plug for spark-ignition internal combustion engines which is improved so as to decrease the undesirable tendency for carbon to adhere to the insulator of the plug.

A spark plug as generally used in spark-ignition internal combustion engines has: a rod-like central electrode which extends along the axis of the plug; an insulator formed of a ceramic material or the like which covers the axial electrode over almost all its length, only the tip of the axial electrode being exposed, and which is generally symmetrical about the axial electrode; and a housing, which is again formed in the general shape of a hollow cylinder, and is made of an electrically conducting material such as metal, which surrounds the insulator with a tubular gap being left therebetween, and which also, at its tip portion, provides at least one ground electrode which opposes the tip of the axial electrode, which is the part of it which is not covered by the insulator. During the use of such a spark plug, inevitably gradually carbon particles adhere to the surface of the insulator which extends between the tip of the axial electrode and the root portion of the plug, where the insulator abuts the grounded housing. Eventually, as they accumulate, these carbon particles lower the surface electrical resistance of the insulator, and in the worst case this resistance drops to such an extent that the plug will not spark, between the electrodes, and engine misfiring occurs, with consequent waste of fuel and poor operating performance of the engine, and also quite possibly increased emission of harmful components in the exhaust of the engine.

Therefore in prior art plugs it has been practiced to make the length of the insulator, extending from the tip to the root thereof, as long as possible, in order to make the resistance of this path, even when lowered by carbon contamination, as high as possible. This surface of the insulator is therefore formed as a long conical or cylindrical surface, and hence, as explained above, a tubular gap is formed between the housing and the insulator.

However, the formation of this tubular gap, in another way, may encourage the formation of carbon deposits. During operation of the engine, air-fuel mixture, burnt air/fuel mixture, sometimes over-rich air/fuel mixture which contains a fine mist of suspended fuel particles, and also soot-laden burnt air/fuel mixture which is the result of combustion of the above over-rich mist-loaded air/fuel mixture, may enter into the deep recesses of this gap, and thereby carbon particles, when produced, are often easily enabled to settle out on the insulator and to adhere thereto. Even though the length of the surface of the insulator between the axial electrode and the ground electrode is quite long, therefore, this kind of plug is not yet free from the problems associated with sooting-up and carbonization.

In view of these problems, it has been proposed to form a constriction on the inner surface of the housing which approaches the insulator at a portion near its tip portion, with an annular gap being left therebetween. In this structure, if the cross-sectional area of the passage between the insulator and the housing in the vicinity of the constriction is made smaller, the circulation of combustible gases into the inner recesses of said tubular gap is more restricted, and the formation of carbon deposits is more effectively reduced. However, it will be apparent that, in order to reduce this cross-sectional area of the passage between the insulator and the housing in the vicinity of the constriction, the width of this annular gap cannot be reduced too much, or otherwise a danger will exist that sparking may occur between the constriction and the axial electrode, which will cause misfiring of the plug, with the attendant disadvantages set out above. Therefore, in general, this width of the annular gap between the constriction and the insulator may not be reduced, with advantage, below a certain minimum width. If then this minimum width is maintained for the annular gap, it will be apparent that, in order to reduce as much as possible the said cross-sectional area of the passage between the insulator and the housing in the vicinity of the constriction, it is advantageous to reduce as much as possible the radius of the insulator at that portion. However, as is well known to one skilled in the art, the heat resistance of a plug is lowered if the insulator is too thin, and the insulator's resistance to cracking is unacceptably low.

SUMMARY OF THE INVENTION

However, in general this heat resistance of the plug is determined by the overall configuration of the insulator, rather than by any such concept as its minimum radius. Therefore, in accordance with an important aspect of the present invention, it is contemplated to form the insulator with a first portion nearer to its root and a second portion nearer to its tip which is of generally smaller radius than the first portion, with a stepped portion between the first and the second portions, where the constriction approaches the second portion at the part thereof which borders on the stepped portion.

By this construction, the thicker root portion of the insulator operates to provide a plug with a greater heat resistance and general durability, while the thinner tip portion of the insulator, where it is surrounded by the constriction, as explained above, means that the overall cross-sectional area of the passage by which soot and carbon particles may enter into the recesses of the tubular gap between the insulator and the housing is reduced as much as possible, consistent with maintaining an appropriate minimum distance between the housing and the insulator at the vicinity of the constriction of the housing.

It is therefore an object of the present invention to provide a spark plug which copes with the aforementioned problems of carbon buildup on the insulator, without making any sacrifice of the durability of the plug.

In accordance with the present invention, this object is attained by a spark plug comprising a central axial electrode, an insulator which covers said axial electrode except for its tip, and a housing which surrounds said insulator with a tubular gap left therebetween and which at its tip portion furnishes at least one ground electrode which opposes the tip of said axial electrode, said housing being formed with a constriction on its inner surface which approaches said insulator at a portion near its tip portion with an annular gap being left therebetween, wherein said insulator is formed with a first portion nearer to its root and a second portion nearer to its tip which is of generally smaller radius than said first portion and a stepped portion between said first and said second portions, and wherein the constriction approaches said second portion at the part thereof where it borders on said stepped portion.

BRIEF DESCRIPTION OF THE DRAWINGS

The present invention will become more clear from the following detailed description of several preferred embodiments of the present invention, taken in conjunction with the following drawings, which, however, are not intended to be in any way limitative of the present invention, but are given for the purposes of illustration only. In the drawings.

DESCRIPTION OF THE PREFERRED EMBODIMENTS

Figure 1:
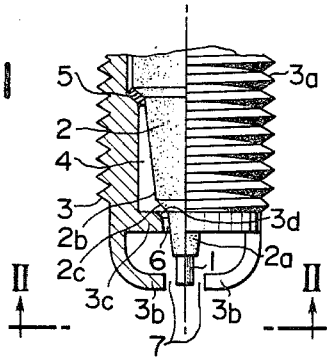
FIG. 1 is a side view of the end portion of a plug which is a first embodiment of the present invention, partly cut away to show the internal structure of the plug.
Figure 2:
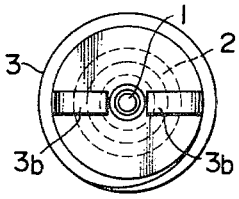
FIG. 2 is an end-on view of the spark plug of FIG. 1, seen in the direction of the arrows II—II in FIG. 1.

In the figures, 1 designates a rod-shaped central electrode which extends along the central axis of the spark plug, and 2 is an insulator made of a ceramic material or the like which is of a form generally symmetrical about the central electrode 1 and which covers the central electrode 1 except for its tip, which protrudes. 3 is a housing made of, in this embodiment, metal, which surrounds the insulator 2 with a tubular gap 4 being left therebetween. The gap between the insulator 2 and the housing 3, at the root or base portions thereof, and therefore at the root end of the tubular gap 4, is sealed with an annular sealing means 5. Around the external part of the housing 3 is cut a male screw thread 3*a*, and by this, in the usual way, the plug is adapted to be mounted in the plug hole of an internal combustion engine, which is provided with a corresponding female screw thread. Further, the housing 3 is provided, at its tip portion, with a pair of ground electrodes 3*b* which oppose the tip of the central electrode 1, with a spark gap 7 being formed therebetween.

Of course, the scope of the present invention is not to be restricted by the particular form of the ground electrodes shown. The ground electrode may not always be formed as a pair of electrodes, and various well-known kinds of electrode construction may be adapted and used within the spirit of the present invention.

The insulator 2 is formed with a portion nearer its tip, designated in the figures by 2*a*, which in general has a comparatively small radius, and with a portion nearer its root, designated by 2*b*, which in general has a comparatively large radius. Between these two portions there is a stepped annular portion 2*c*, which joins them. In the shown embodiment, this stepped annular portion does not lie in a plane perpendicular to the axis of the insulator 2, but is formed as a frustum of a cone with a large vertex angle. Further, the portions 2*a* and 2*b* are not formed as cylindrical portions, in the shown embodiment, but as frusta of cones with small vertex angles. Thus, the use of the term "radius" for these portions 2*a* and 2*b* should be understood in the broadest sense.

According to the present invention, the housing 3 has a constriction 3*c* formed on its inside surface, which opposes the insulator 2 over the portion 2*a*, just where this portion 2*a* borders on the portion 2*b*. Further, according to a feature of the present invention, the inner shape of the constriction 3*c* is formed so as to conform to the outer shape of the portion 2*a* where it opposes the constriction 3*c*, and thus, in the present embodiment, is formed as a frustrum of a cone which has a small vertex angle. Still further, according to another feature of the present invention, the constriction 3*c* also partly opposes the stepped annular portion 2*c*, and the part of the constriction 3*c* which does so, again, is formed so as to conform to the shape of the confronting portion of the stepped annular portion 2*c*, and therefore in the shown embodiment is formed as the frustum of a cone 3*d* which has a large vertex angle. Thus, as a whole, the constriction 3*c* conforms closely to the shape of the insulator around which it fits, with a small and uniform annular gap 6 being left therebetween.

Thus, at the approach part of the tubular gap 4, a curving passage is formed, which has, as explained above, the minimum possible cross-sectional area consistent with its being of a certain minimum width, and consistent with a certain desired degree of heat resistance and general strength of the spark plug. The feature that this passage is curving forms a very useful barrier to the entrance of soot and carbon into the internal space of the tubular gap 4, because the curve constitutes a sort of powder particle trap. By this construction, the amount of carbon which adheres to the surface of the inner portion 2*b* of the insulator 2 is very satisfactorily reduced. Further, by the stepped annular portion 2*c* the length of the outer surface of the insulator measured from its tip end to its root end is increased, and its insulating performance is increased.

Further, it is to be noted that, although during normal operation of the spark plug the electrical discharge takes place exclusively between the central electrode 1 and the ground electrodes 3*b* across the spark gap 7, when the plug becomes, as inevitably may happen, somewhat covered with carbon particles over the portion 2*a* of the projecting insulator, due to cold operation, over-rich operation, or operation under special and transient operating conditions, or the like, then the portion 2*a* of the insulator acquires a certain electrical conductivity, and a sort of surface discharge commences between the central electrode and the constriction 3*c*, via the surface carbon layer on 2*a*, although not to such a degree as to cause total misfiring of the spark plug. This surface discharge has the effect of burning away the carbon layer deposited on the surface of the portion 2*a*, and when the conditions which have caused the deposition of the carbon layer have changed, and the engine is again operating normally, this carbon layer is quickly consumed, and the plug is cleared of carbon particles by a sort of self-cleansing action.

Figure 3:
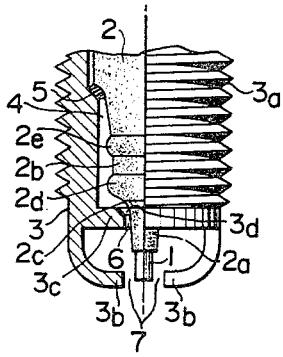
FIG. 3 is a side view, partly cut-away and similar to FIG. 1, showing a second embodiment of the spark plug of the present invention.

In FIG. 3 there is shown a second embodiment of the spark plug of the present invention, again in side view and partly cut away for the convenience of illustration. In FIG. 3, parts which correspond to parts shown in FIG. 1 are designated by the same reference numbers. In this embodiment, the structure of the plug is the same, except that the root portion 2*b* of the insulator is formed with two annular bulges 2*d* and 2*e* around it. These bulges serve to lengthen the surface path along the insulator 2 from the central electrode 1 to the base of the insulator 2 where it abuts the housing 5. Thus as described with respect to the stepped annular portion 2*c*, they serve to increase the surface resistance of any coating of carbon particles that may appear thereon. In the shown embodiment, one of these bulges along its one side forms a continuation of the conical frustum shape of the stepped annular part 2*c* of the insulator 2.

Although the present invention has been shown and described with respect to some preferred embodiments thereof, it should be understood that various changes and modifications to the form and the detail thereof may be made by one skilled in the art without departing from the scope of the invention. Therefore the scope of monopoly sought is not to be defined by any of the details of the illustrative embodiments described, or of the drawings, but only by the appended claims.

We claim:

1. A spark plug comprising a central axial electrode, an insulator which covers said axial electrode except for its tip, and a housing which surrounds said insulator with an open tubular gap left therebetween and which at its tip portion furnishes at least one ground electrode which opposes the tip of said axial electrode, said housing being formed with a constriction on its inner surface which approaches said insulator at a portion near its tip portion with an open annular gap being left therebetween, wherein said insulator is formed with a first portion nearer to its root, a second portion nearer to its tip which is of generally smaller radius than said first portion, and a stepped portion between said first and second portions, and wherein the constriction has an annular inside surface which opposes both said second portion and said stepped portion, said constriction inside surface and the surfaces of said insulator at said second portion and said stepped portion being shaped to define an open annular gap therebetween which has a substantially constant width throughout its length, said open annular gap angling sharply radially outwardly from its portion which follows said second portion to its portion which follows said stepped portion of the insulator, said first portion of said insulator being formed with an annular bulge which extends in continuity with said stepped portion.

* * * * *